US012111125B2

(12) United States Patent
Kelley et al.

(10) Patent No.: US 12,111,125 B2
(45) Date of Patent: Oct. 8, 2024

(54) ELECTROMECHANICAL GUN

(71) Applicant: Biofire Technologies Inc., Broomfield, CO (US)

(72) Inventors: Donna Kelley, Louisville, CO (US); Jack Hugo Thiesen, Firestone, CO (US); Katherine Joanne Lund, Westminster, CO (US); Sara Elizabeth Falcone, Lafayette, CO (US); Benjamin William Dwyer, Golden, CO (US); Kai Thorin Kloepfer, Denver, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 18/180,709

(22) Filed: Mar. 8, 2023

(65) Prior Publication Data

US 2023/0243611 A1 Aug. 3, 2023

Related U.S. Application Data

(63) Continuation of application No. 17/661,243, filed on Apr. 28, 2022, now Pat. No. 11,624,575.

(60) Provisional application No. 63/181,093, filed on Apr. 28, 2021.

(51) Int. Cl.

| | |
|---|---|
| ***F41A 17/06*** | (2006.01) |
| ***F41A 3/88*** | (2006.01) |
| ***F41A 17/46*** | (2006.01) |

(52) U.S. Cl.
CPC ..... *F41A 17/06* (2013.01); *F41A 3/88* (2013.01); *F41A 17/46* (2013.01)

(58) Field of Classification Search
CPC ..... F41A 17/06; F41A 17/46; F41A 3/88
USPC ..... 89/196
See application file for complete search history.

(56) References Cited

U.S. PATENT DOCUMENTS

| | | | | |
|---|---|---|---|---|
| 3,982,347 | A * | 9/1976 | Brandl | F41A 19/62 42/84 |
| 4,134,223 | A * | 1/1979 | Hillenbrandt | F41A 19/59 42/84 |
| 8,539,706 | B1 * | 9/2013 | Vieweg | F41A 3/82 42/1.06 |
| 11,326,847 | B1 * | 5/2022 | Bango | F41A 17/063 |

(Continued)

FOREIGN PATENT DOCUMENTS

WO WO-2022232821 A1 * 11/2022 ..... F41A 17/06

*Primary Examiner* — Samir Abdosh
(74) *Attorney, Agent, or Firm* — Perkins Coie LLP; Andrew T. Pettit

(57) ABSTRACT

The present disclosure provides systems, devices, and techniques that can be implemented at a gun, such as an electromechanical gun. The gun may include a barrel located within a slide and a cylindrical spring enveloping the barrel. The barrel may be configured to act as a guide rod for the cylindrical spring, and the cylindrical spring may be configured to bias the slide in a forward battery position. The gun may include an electronic component such as an energy store, a processor, or a circuit board, located under the barrel and forward of the trigger when the gun is in an upright position. The gun may include a physical transmission medium that electronically couples the electronic component with an additional electronic component located rearward of the trigger, and the physical transmission medium may be at least partially encapsulated by a trigger guard.

9 Claims, 12 Drawing Sheets

400

700

(56) References Cited

U.S. PATENT DOCUMENTS

| | | | | |
|---|---|---|---|---|
| 2006/0242879 | A1* | 11/2006 | Schmitter | F41A 17/063 42/70.01 |
| 2016/0054081 | A1* | 2/2016 | Creed | F41A 17/46 42/70.06 |
| 2016/0348994 | A1* | 12/2016 | Allan | F41A 17/46 |
| 2022/0307786 | A1* | 9/2022 | Kloepfer | F41G 1/34 |
| 2022/0307787 | A1* | 9/2022 | Kloepfer | G07C 9/00563 |
| 2022/0341702 | A1* | 10/2022 | Owens | F41A 17/066 |
| 2024/0027158 | A1* | 1/2024 | Pellegrini | F41A 17/20 |

* cited by examiner

100

200

400

500

600

700

800

1000

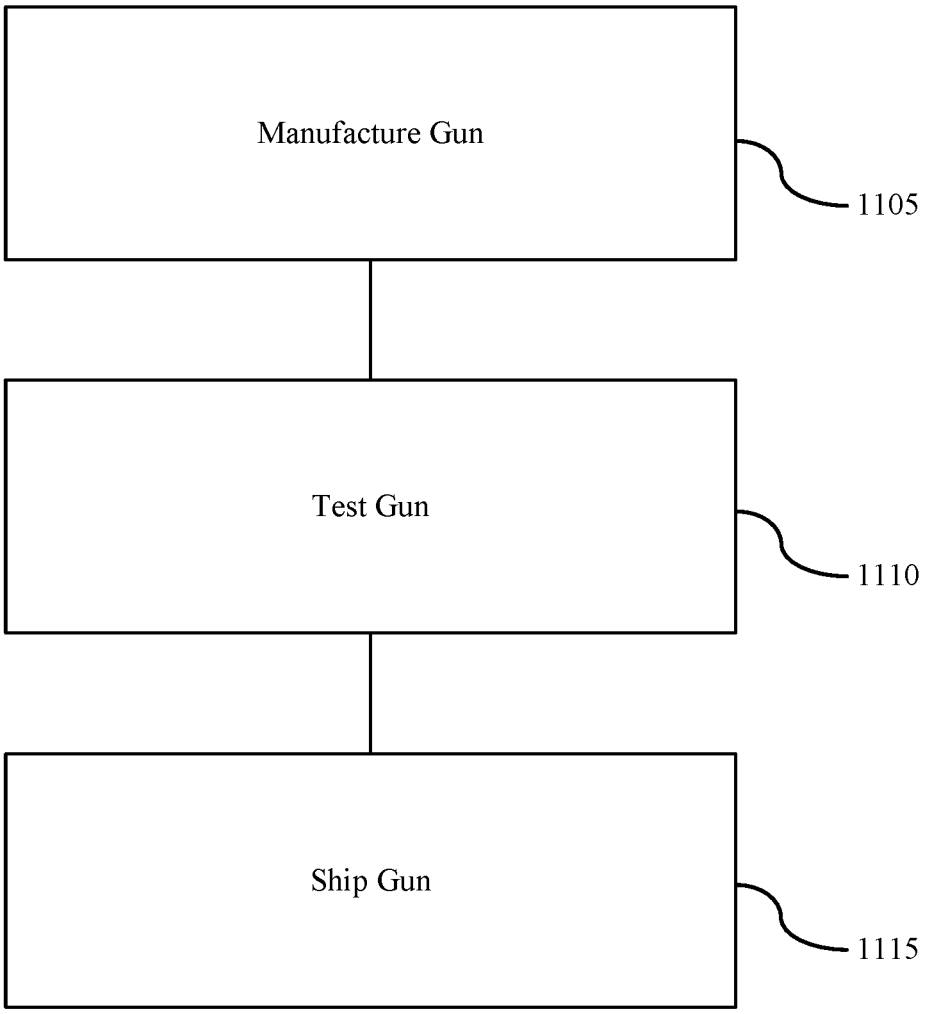
FIG. 11
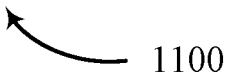

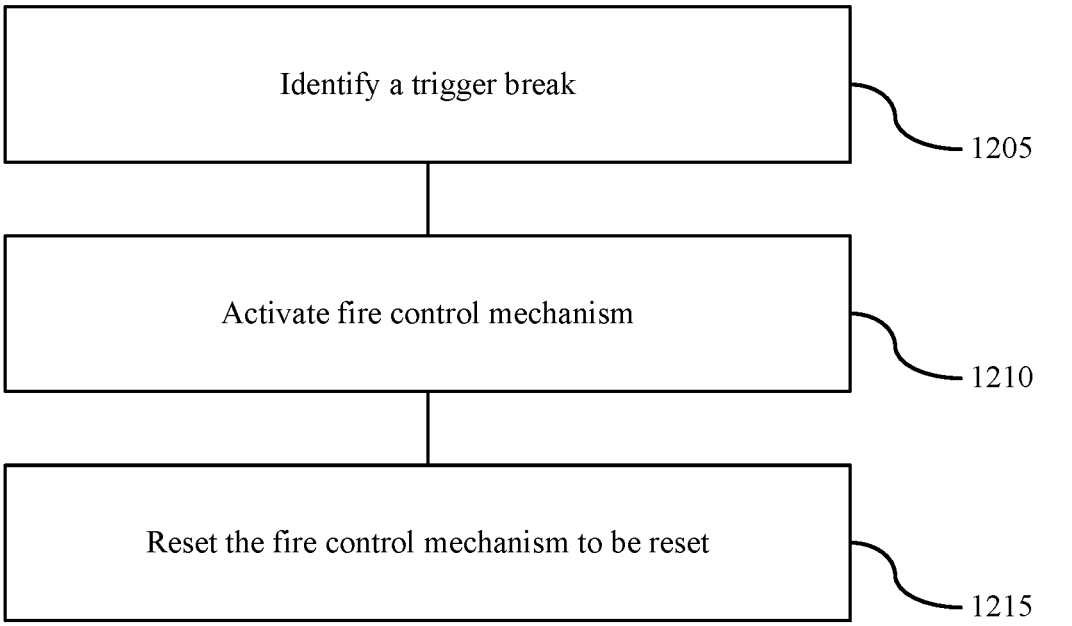
FIG. 12
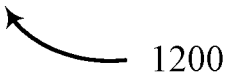

ELECTROMECHANICAL GUN

CROSS-REFERENCE TO RELATED APPLICATIONS

This application is a continuation of U.S. patent application Ser. No. 17/661,243, titled "ELECTROMECHANICAL GUN" and filed Apr. 28, 2022, which claims priority to U.S. Provisional Application No. 63/181,093, titled "ELECTROMECHANICAL GUN" and filed on Apr. 28, 2021, which are all incorporated by reference herein in their entireties.

FIELD OF TECHNOLOGY

The teachings disclosed herein generally relate to guns, and more specifically to electromechanical guns.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support an electromechanical gun that includes both mechanical and electronic components. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the described systems and techniques described herein provide a gun including electronic components that are communicatively coupled as well as an energy store that is capable of providing power to the electronic components. The gun may include a barrel located within a slide and a cylindrical spring enveloping the barrel. The barrel may be configured to act as a guide rod for the cylindrical spring, and the cylindrical spring may be configured to bias the slide in a forward battery position. The gun may include an electronic component, such as an energy store, a processor, or a circuit board, located under the barrel and forward of the trigger when the gun is in an upright position. The gun may include a physical transmission medium that electronically couples the electronic component with an additional electronic component located rearward of the trigger, and the physical transmission medium may be at least partially encapsulated by a trigger guard.

BRIEF DESCRIPTION OF THE DRAWINGS

FIG. 11 illustrates an example of a flowchart showing a method of manufacturing an electromechanical gun.

FIG. 12 illustrates an example of a flowchart showing a method of firing an electromechanical gun.

Figure 1:
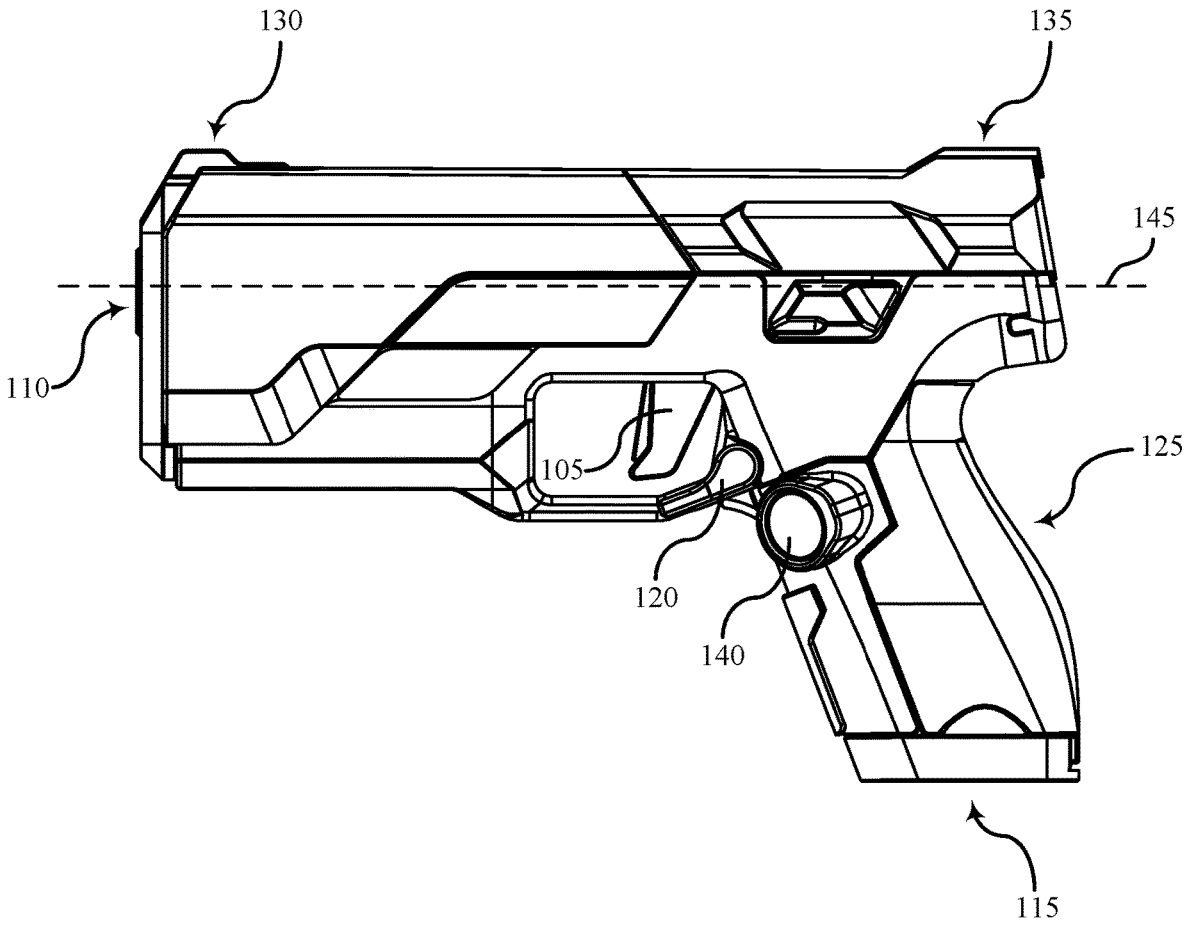
FIG. 1 illustrates an example of a gun that includes both electronic and mechanical components.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Some conventional guns include electronic components, such as a light-emitting diode (LED) or a laser sight. Such electronic components can function at low levels of power, which allows such guns to include a small battery, such as the button cell batteries (also called "coin cell batteries") that are commonly used in watches. Such guns fail to sufficiently power electronic components that function at higher levels of power, such as a flashlight that is integrated into the gun or an electromechanical fire control system that is integrated into the gun.

Some conventional gun designs have been modified to include electronic components that draw low levels of power, such as LEDs, but conventional gun designs prevent the incorporation of larger electronic components due to space constraints, power constraints, or methods of operation. Conventional gun designs therefore inhibit the implementation of an electronic fire control system. For example, many conventional handguns include a guide rod underneath the barrel of the gun while the gun is held in an upright position. Note that the term "upright position," as used herein, generally refers to a scenario in which the gun is oriented as if in a high ready position with the barrel roughly parallel to the ground. But including a guide rod underneath the barrel of the gun takes up space and can inhibit the incorporation of electronic components in the gun. As another example, conventional guns that do include an electronic component generally include an electronic component that can function independently, so a communication network that facilitates inter-component communication is unnecessary. For example, a conventional gun design may be modified relatively easily to include a single LED, as the LED and a small battery (e.g., in button cell form) can be embedded in the frame of the gun without changing the mechanical design of the gun. Additionally, since the electronic components of conventional guns generally consume small amounts of power, conventional guns generally include batteries with small power capacities.

Including multiple electronic components can pose a challenge, as not only the space taken up by the electronic components increases as the number of electronic components increases, so too does the power consumption of the electronic components and the complexity of connecting the multiple electronic components. In summary, conventional guns include few electronic components, if any, so conventional gun designs fail to accommodate larger electronic components, such as an electronic fire control system, a higher capacity battery, or inter-component communication.

Introduced here, therefore, is an electromechanical gun including a communication network that electronically couples multiple electronic components of the gun. The systems and techniques described herein provide a communication network that facilitates communication across multiple electronic components and a mechanical architecture that creates space for the electronic components while creating a packaging that protects the electronic components and delivers an ergonomic gun.

The systems and techniques described herein may be implemented in the context of small arms weapons, such as a semi-automatic pistol, to produce a gun that is robust, reliable, and ergonomic. The gun described herein may be an example of an auto-loading firearm, such as a locked-breech firearm. The gun may include a recoil spring that causes the slide to return to battery after recoiling, and the recoil spring may envelope the barrel. In other words, the barrel may act as a guide rod for the recoil spring, thereby freeing up space under the barrel for components other than a dedicated guide rod. A circuit board may be located under the barrel, and the circuit board may be potted into an alloy frame with a heat resistive potting compound, such as a thermally resistive epoxy. An energy store, such as a single battery or a collection of multiple batteries (also called a "battery pack"), may also be located under the barrel. For example, the circuit board may be potted into the frame of the gun underneath the barrel, and the energy store may be positioned underneath the circuit board and in front of a trigger guard. Positioning the energy store in the free space under the barrel provides many benefits, such as the ability to place a large capacity (e.g., over 1,000 milliampere hour (mAh)) energy store in close proximity to the circuit board. Positioning the energy store underneath the barrel also allows a user of the gun to easily access the energy store to perform maintainence, charge the energy store, remove the energy store, or the like.

The gun described herein may also include a communication network that supports communication between multiple electronic components located throughout the gun. As an example, the energy store may be located forward of the trigger guard and beneath the barrel, while a biometric sensor may be located rearward of the trigger guard and within a grip component. The energy store may provide power to the biometric sensor, and the energy store may power the biometric sensor by directing electric current from the energy store to the biometric sensor via a communication channel that is routed through the trigger guard. The communication channel may be an example of a flexible circuit or a flexible transmission medium, and the energy store may be an example of a battery, a battery pack, a capacitor, a capacitor bank, or the like. Routing the communication channel through the trigger guard connects the electronic components at the front of the gun with the electronic components at the rear of the gun in an unobtrusive fashion.

Additionally, the gun may include an electronic fire control system, and the battery pack may deliver power to an electronic actuator to fire the gun. For example, the actuator may retain a striker, the battery pack may deliver power to a capacitor, and the actuator may release the striker in response to the capacitor directing electric charge at the actuator, causing the actuator to activate and release the striker. In other words, the electric charge may cause the actuator to be displaced, which may result in the release of the striker.

Embodiments may be described in the context of executable instructions for the purpose of illustration. For example, a fire control manager in a gun may be described as being capable of implementing logic that permits the user to fire the gun. The fire control manager may be implemented in an electrical circuit that includes analog components, digital components, or both. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor do they necessarily refer to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that includes both electronic and mechanical components. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly applicable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint sensor (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked in based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 may include an energy store capable of powering the electronic components of the gun 100. For example, the gun 100 may include a battery pack that is electronically coupled with the user presence sensor 125 and the biometric sensor 140 via a physical transmission medium (also referred to as a "communication channel"), and the energy store may provide power to the user presence sensor 125 and the biometric sensor 140 via the physical transmission medium. The physical transmission medium may include a wire or fiber, such as a copper wire or an optical fiber.

The barrel 110 may be located within a slide of the gun 100, and a recoil spring may envelope the barrel 110 such that the barrel 110 acts as a guide rod for the recoil spring. The recoil spring may bias the slide, the barrel 110, or a breechblock in a forward battery position such that the chamber of the gun 100 is closed. For example, the breechblock may contact a rearward surface of the barrel 110, thereby closing the chamber of the gun 100. The energy store may be located under the barrel 110 and forward of the trigger 105 when the gun is in an upright position. The gun 100 may include a physical transmission medium that electronically couples an electronic component located in a forward region of the gun (e.g., forward of the trigger 105) with an additional electronic component located in a rearward region of the gun (e.g., rearward of the trigger 105). For example, the physical transmission medium may electronically couple the energy store with the user presence sensor 125 and the biometric sensor 140. The physical transmission medium may be encapsulated within the gun 100. For example, a first portion of the physical transmission medium may be encapsulated by the frame, a second portion of the physical transmission medium may be encapsulated by the trigger guard, and a third portion of the physical transmission medium may be encapsulated by the grip.

Figure 2:
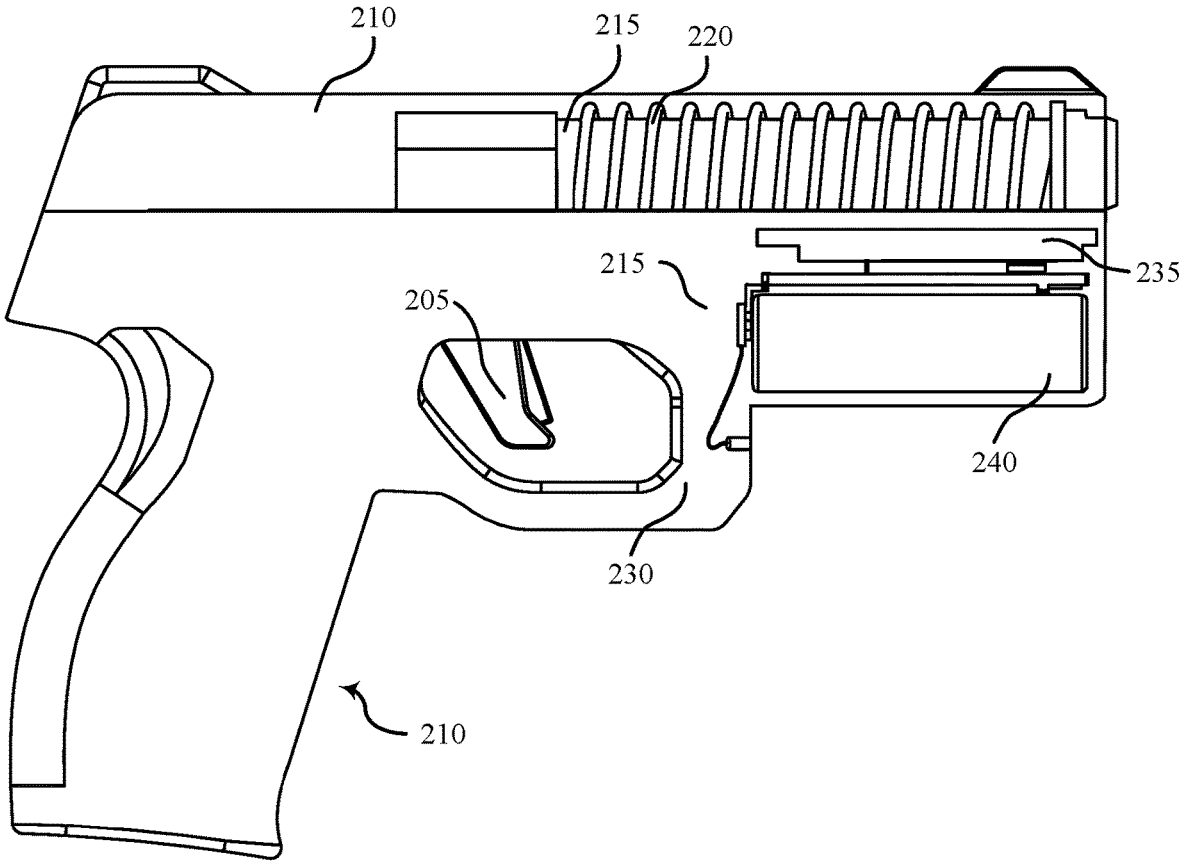
FIG. 2 illustrates an example a gun that includes both electronic and mechanical components.

FIG. 2 illustrates an example of a gun 200 that includes both electronic and mechanical components. The gun 200 may be an example of, or include aspects of, the gun 100 described with reference to FIG. 1.

The gun 200 includes a trigger 205 and a slide 210. The trigger 205 may be configured such that pulling the trigger 205 results in a projectile (e.g., a bullet) being fired from the barrel 215. The spring 220 may be configured to envelope the barrel 215 such that the barrel 215 acts as a guide rod for the spring 220, and the spring 220 may bias the slide 210 in a battery position. A locking mechanism, such as a lug, a groove, a falling block, a piston, a cylinder, or any combination thereof may temporarily lock the barrel 215 to the slide 210 such that both the barrel 215 and the slide 210 travel rearward together for a first distance and the slide 210 travels rearward for a second distance while the barrel 215 remains stationary. In other words, both the slide 210 and the barrel 215 may travel rearward together, but the barrel 215 may stop traveling rearward after the first distance and the slide 210 may continue traveling rearward for a second distance. The spring 220 may bias the slide 210 in a forward position such that the slide 210 and the barrel 215 return to battery following recoil. Using the barrel 215 as a guide rod for the spring 220 mitigates the need for a separate guide rod, thereby improving the efficiency of space utilization and allowing other components to be located under the barrel 215.

The gun 200 includes a processor 235 and an energy store 240 under the barrel 215. The processor 235 and/or the energy store 240 may be located forward of the trigger guard 230. The gun 200 may include one or more electronic components below the barrel 215. Examples of electronic components include a circuit board, a printed circuit board (PCB), a PCB assembly (PCBA), a physical communication channel (e.g., a bus, a physical transmission medium, a copper wire, an optical fiber, etc.), a digital electronic component (e.g., a processor, an application-specific integrated circuit (ASIC), a field-programmable gate array (FPGA), etc.), and an analog electronic component (e.g., an differential amplifier, a capacitor, a resistor, an inductor, a transistor, a diode, etc.).

Temporarily locking the barrel 215 to the slide 210 allows a projectile to exit the muzzle of the gun 200 before the slide 210 separates from the barrel 215 and opens the breech (also referred to as a "chamber") and allows hot, pressured gas to escape. The spring 220 biases the slide 210 such that the slide assumes a battery position by default, and using the barrel 215 as a guide rod for the spring 220 mitigates the need for a dedicated guide rod, thereby freeing up space for electronic components, such as the energy store 240 and/or the processor 235, under the barrel 215.

Figure 3:
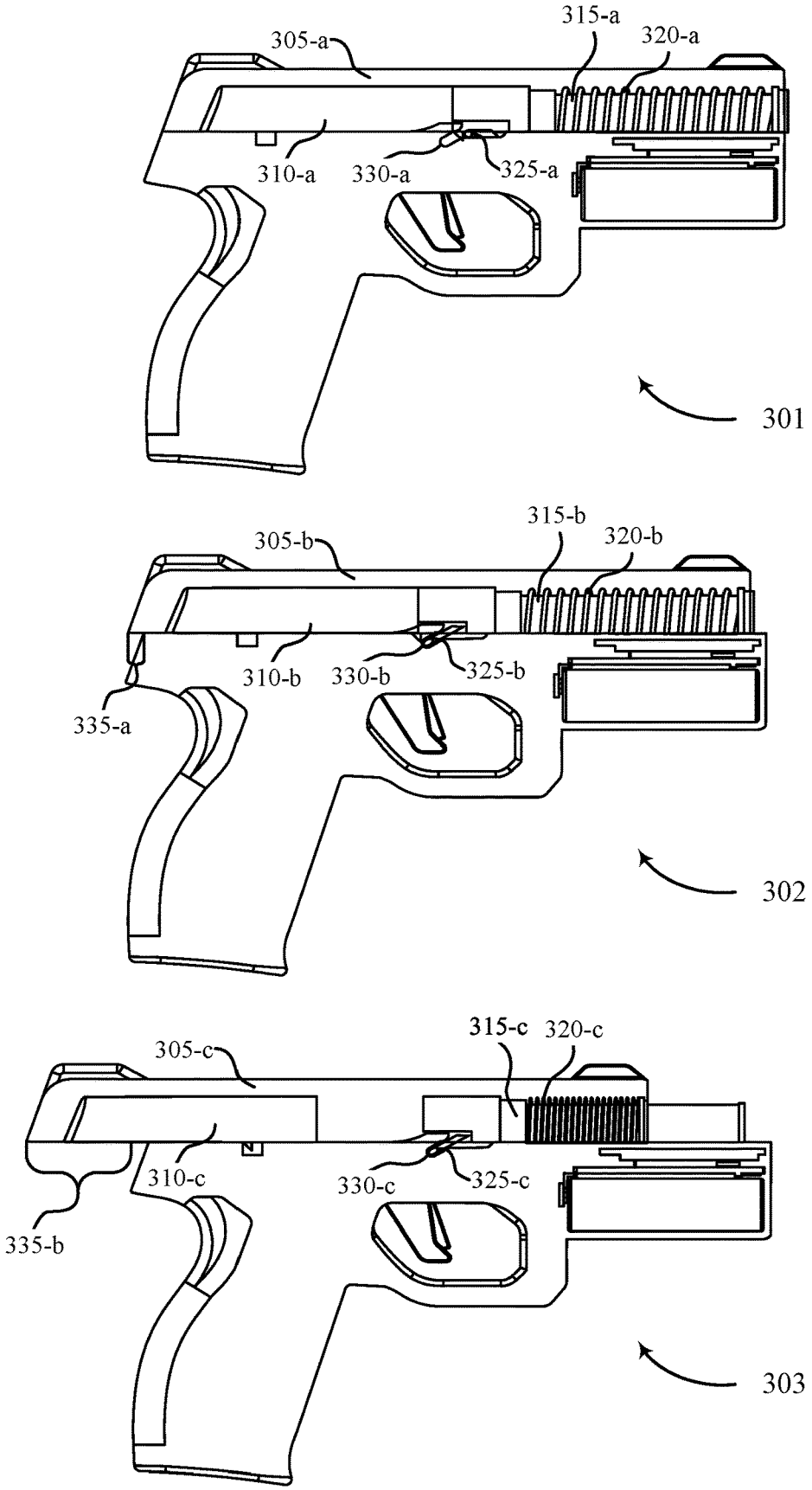
FIG. 3 illustrates examples of gun at various stages of recoil.

FIG. 3 illustrates examples of guns at various stages of recoil. The gun 301 illustrates a gun in battery, the gun 302 illustrates a gun in short recoil, and the gun 303 illustrates a gun in long recoil. The slide of a gun may travel the full length of recoil (which may be referred to as "long recoil"), but the barrel of a gun may travel a partial length of recoil (which may be referred to as "short recoil").

The gun 301 is in battery, where the slide 305-*a* is in a forward position and where the breechblock 310-*a* (which may be referred to as a "bolt") is in a forward position such that the breechblock 310-*a* is in contact with the barrel 315-*a*. Since the breechblock 310-*a* is in contact with the barrel 315-*a*, the chamber is closed and the gun 301 is in battery. The spring 320-*a* may bias the slide 305-*a* in the forward position.

The gun 301 includes a falling block 325-*a* and a groove 330-*a*. The falling block 325-*a* may be used to lock the barrel 315-*a* to the slide 305-*a* such that both the barrel 315-*a* and the slide 305-*a* travel rearward during short recoil (as shown by the gun 302), and such that the slide 305-*a* continues moving rearward during long recoil while the barrel 315-*a* remains stationary (as shown by the gun 303).

The gun 302 is in a short recoil position, where the slide 305-*b* has been displaced rearward for a distance 335-*a* (also referred to as a "first distance"). The slide 305-*b*, the breechblock 310-*b*, and the barrel 315-*b* may all travel rearward for the distance 335-*a*. The barrel 315-*b* may stop traveling rearward based on the falling block 325-*b* contacting the groove 330-*b* such that the barrel 315-*b* remains stationary with respect to the frame of the gun. As the slide 305-*b* travels rearward, the spring 320-*b* may be compressed. The spring 320-*b* may cause the slide 305-*b* to return to battery when the chamber pressure becomes lower than the force exerted by the spring 320-*b*.

The gun 303 is in a long recoil position, where the slide 305-*c* has been displaced rearward for a distance 335-*b* (also referred to as a "second distance"). The slide 305-*c* and the breechblock 310-*c* may travel rearward for the distance 335-*b*, while the barrel 315-*c* may remain stationary. The falling block 325-*c* may contact the groove 330-*c*, thereby stopping the barrel 315-*c* and preventing the barrel 315-*c* from traveling the second distance rearward.

The spring 320-*c* may be compressed, and the spring 320-*c* may force the slide 305-*c* back into battery. For example, the barrel 315-*c* may act as a guide rod for the spring 320-*c*, the spring 320-*c* may store energy harvesting during recoil (e.g., as the slide travels rearward the first distance and the second distance), and the spring 320-*c* may exert force on the slide 305-*c* to force the slide 305-*c* into battery.

Figure 4:
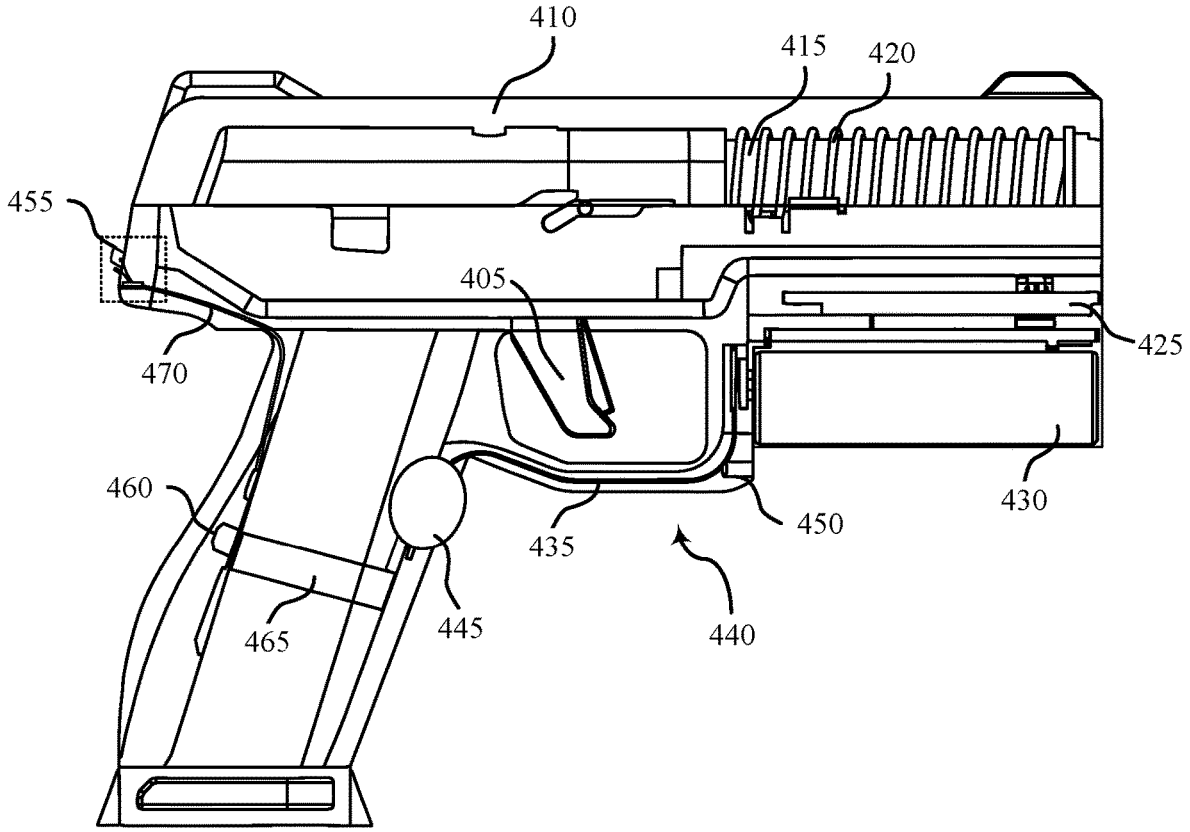
FIG. 4 illustrates an example of a right-side view of a gun that includes both mechanical and electronic components.

FIG. 4 illustrates an example of a right-side view of a gun 400 that includes both mechanical and electronic components.

The gun 400 may include multiple mechanical components, such as a trigger 405, a slide 410, a barrel 415, and a recoil spring 420. The recoil spring 420 may be configured to bias the slide 410 in a first position (e.g., in battery), and the recoil spring 420 may envelop the barrel 415. The circuit board 425 and the energy store 430 may be located below the barrel 415 and forward of the trigger 405. The circuit board 425 may include one or more analog and/or digital components, such as an electrical circuit including a differential amplifier and a digital processor. The energy store 430 may include battery cells and/or capacitors. For example, the energy store 430 may be an example of a battery pack or a capacitor bank.

The trigger 405 may be operable to cause the gun 400 to fire a projectile (e.g., a bullet) from the barrel 415. In some examples, the trigger 405 may be mechanically coupled with a striker or a hammer, and pulling the trigger 405 may result in the striker or hammer directing a firing pin into a cartridge primer cap so as to ignite the primer and propel a projectile through the barrel 415. In other examples, pulling the trigger 405 may result in the transmission of an electrical signal within the gun 400, and the electrical signal may cause the gun 400 to fire a projectile from the barrel 415. For example, the electrical signal may cause an actuator to release a striker, or the electrical signal may cause a conductive firing pin to ignite an electronically activated primer.

The gun 400 may include multiple electronic components, such as the circuit board 425 and the energy store 430. The gun 400 may also include a communication channel 435, a fingerprint scanner 445, an electrical interface 450, an image sensor 455, a haptic motor 460, a communication channel 465, and a communication channel 470. The image sensor 555 may be an example of a camera that supports performing a facial recognition procedure.

The energy store 430 may provide power to electronic components of the gun 400. For example, the energy store 430 may provide power to the fingerprint scanner 445 via the communication channel 435 that is routed through the trigger guard 440. The communication channel 435 may be an example of a physical communication channel, such as a bus, a wire, or another physical transmission medium. In some examples, the communication channel 435 may implement a communication protocol, such as an inter-integrated circuit (I2C) protocol, a serial peripheral interface (SPI) protocol, a universal asynchronous reception and transmission (UART) protocol, or the like. The communication channel 435 may include the electrical interface 450, and the electrical interface 450 may be configured to mate with a complementary electrical interface of a device that is external to the gun 400. The electrical interface 450 may be an example of a physical electrical interface, such as a USB-C connector, a micro-USB connector, a lightning connector, or the like. The electrical interface 450 may be embedded in the trigger guard 440.

The communication channel 465 may communicatively couple the haptic motor 460 with the communication channel 435. The communication channel 470 may communicatively couple the image sensor 455 with the communication channel 435. For example, the image sensor 455 may be communicatively coupled with the communication channel 465, the communication channel 465 may be communicatively coupled with the communication channel 435, and the communication channel 435 may be communicatively coupled with the circuit board 425.

Figure 5:
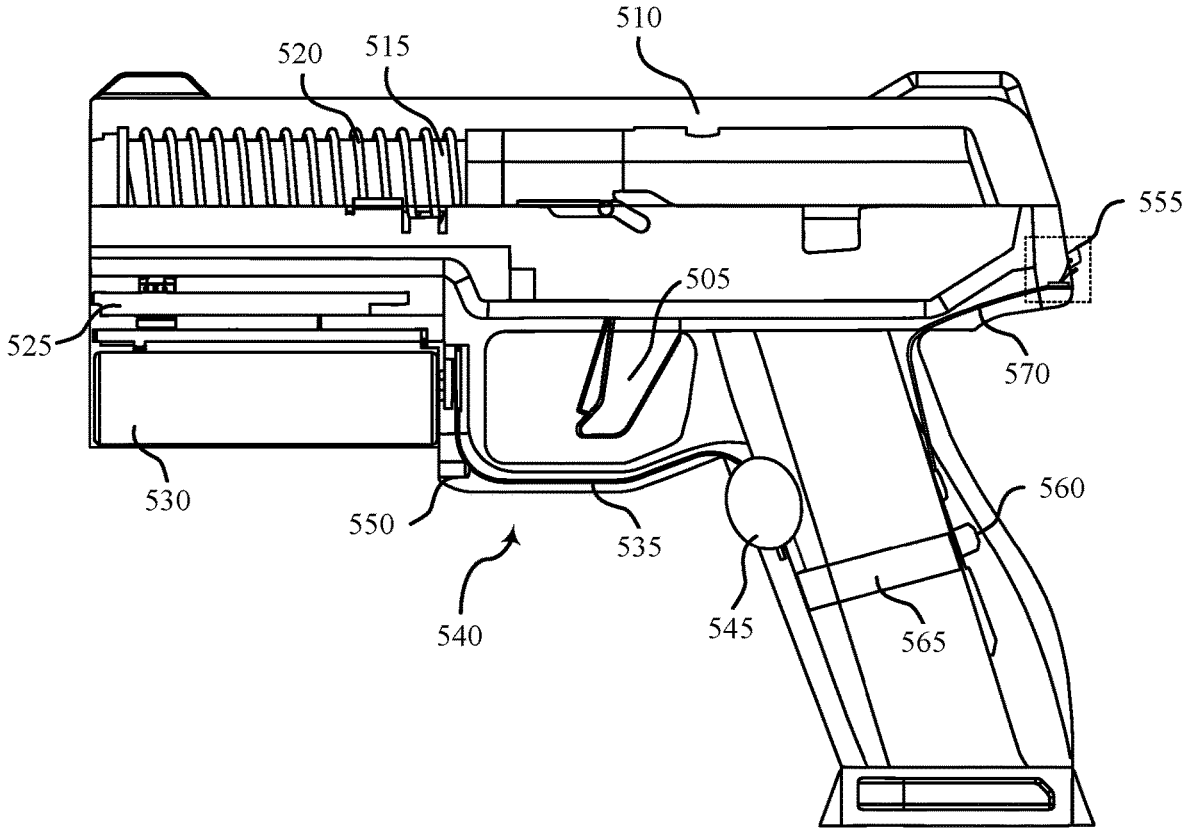
FIG. 5 illustrates an example of a left-side view of a gun that includes both mechanical and electronic components.

FIG. 5 illustrates an example of a left-side view of a gun 500 that includes both mechanical and electronic components.

The gun 500 may include multiple mechanical components, such as a trigger 505, a slide 510, a barrel 515, and a recoil spring 520. The recoil spring 520 may be configured to bias the slide 510 in a first position (e.g., in battery). The trigger 505 may be operable to cause the gun 500 to fire a projectile (e.g., a bullet) from the barrel 515. In some examples, the trigger 505 may be mechanically operable to fire the gun 500, while in some other examples, the trigger 505 may be electronically operate to fire the gun 500. In other words, the trigger 505 may be mechanically coupled to a sear, or the trigger 505 may be electronically coupled with a trigger sensor, such as a Hall effect sensor, an optical interrupt sensor, a load cell, or the like.

The gun 500 may include multiple electronic components, such as a circuit board 525, an energy store 530, a communication channel 535, a fingerprint scanner 545, an electrical interface 550, an image sensor 555, a haptic motor 560, a communication channel 565, and a communication channel 570. The energy store 530 may provide power to electronic components of the gun 400. The image sensor 555 may be an example of a camera that supports performing a facial recognition procedure.

The trigger 505 may be operable to cause the gun 500 to propel a projectile though the barrel 515. The barrel 515 is enveloped by the recoil spring 520, and the barrel 515 is housed in the slide 510. The circuit board 525 and the energy store 530 may be located below the barrel and forward of the trigger guard 540. The circuit board 525 may include one or more analog and/or digital components, such as an electrical circuit including a differential amplifier and a digital processor. The energy store may include battery cells and/or capacitors. For example, the energy store 530 may be an example of a battery pack or a capacitor bank.

Figure 6:
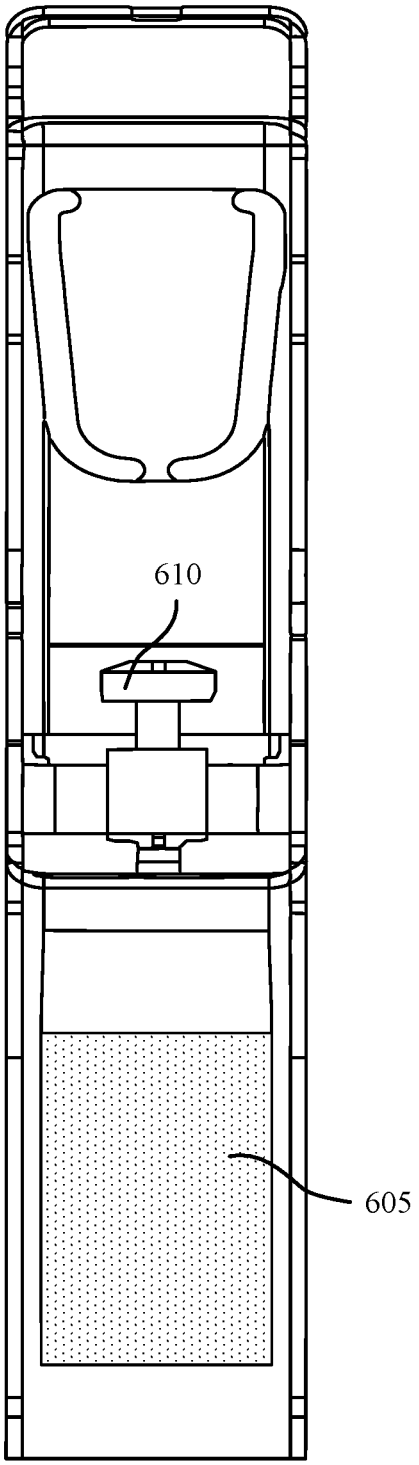
FIG. 6 illustrates an example of an electronic fire control system.

FIG. 6 illustrates an example of a fire control system 600 which may be an aspect of a gun described herein. The fire control system 600 includes a fire control manager 605 and a fire control mechanism 610.

The fire control manager 605 may implement logical operations to manager or control the fire control mechanism 610. The fire control manager 605 may include an electrical circuit, such as an electrical circuit including analog components and/or digital components. As an example, the fire control manager 605 may include an analog circuit configured to direct electrical current at the fire control mechanism 610, and the fire control mechanism 610 may be displaced based on the electrical current, causing the gun to fire. As another example, the fire control manager 605 may include a processor configured to perform a user authentication procedure, and the fire control mechanism 610 may be displaced based on the processor generating an output indicating that the user is authorized to operate the gun. The fire control manager 605 may be an aspect of a system manager described herein.

The fire control manager 605 and/or the fire control mechanism 610 may be coupled with an energy store, and the energy store may be located below the fire control manager 605. In some examples, displacing the fire control mechanism 610 may result in disengagement of a safety mechanism, such as an electromechanical drop safety or an electromechanical firing pin safety, and the gun may be capable of firing a projectile based on the disengagement of the safety mechanism. The fire control mechanism 610 is depicted as an actuator, such as a solenoid-based actuator or a piezoelectric-based actuator, but it should be understood that the fire control mechanism 610 may be implemented as an actuator, a conductive rod, a diode capable of transmitting a beam of light at a cartridge propellant so as to ignite the propellant, a mechanism for generating an electromagnetic field so as to accelerate a projectile through a barrel, or the like. The fire control manager 605 many determine that the gun is to be fired and transmit an electrical signal to the fire control mechanism 610 so as to activate the fire control mechanism 610 and cause the gun to fire.

Figure 7:
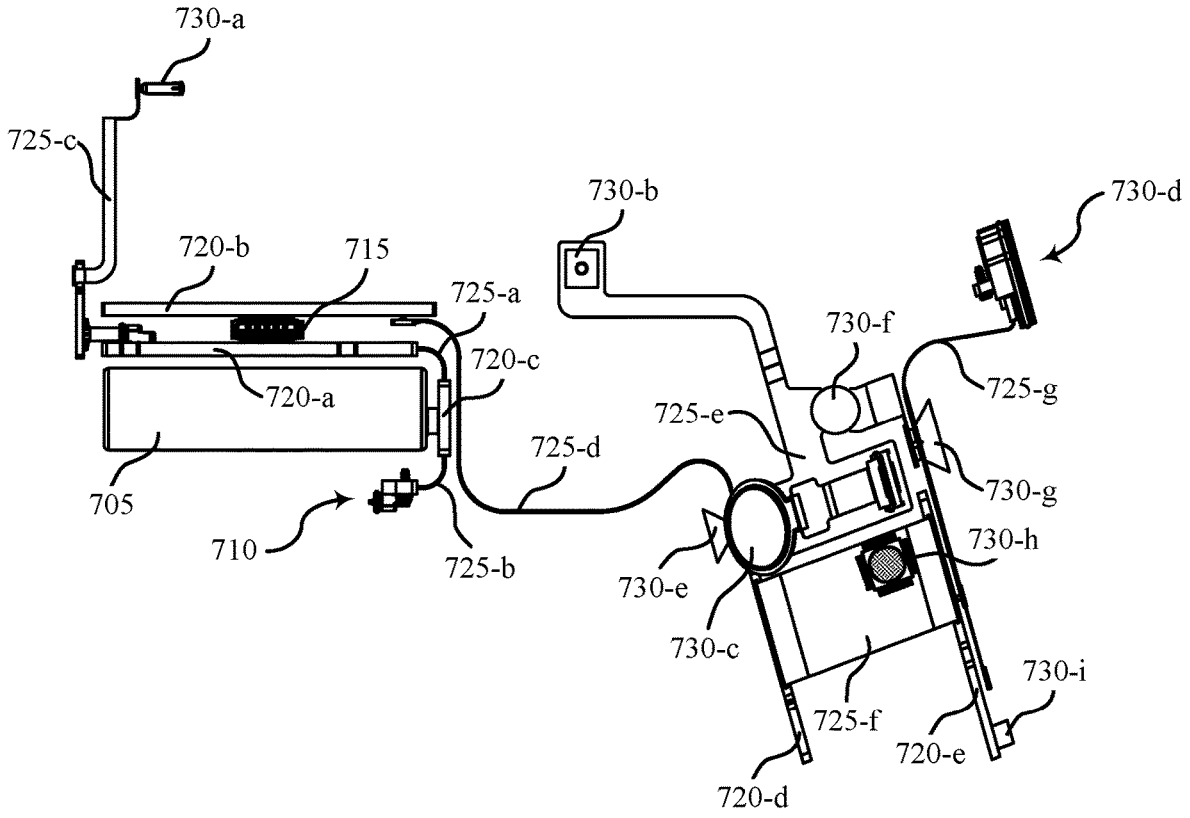
FIG. 7 illustrates an example of a communication network for a gun.

FIG. 7 illustrates an example of a communication network 700. The communication network 700 may be an aspect of an electromechanical gun, such as a gun that include an electronic fire control mechanism, a gun that includes a biometric sensor, a gun that includes an image sensor, a gun that includes a proximity sensor, a gun that includes a light-emitting diode (LED), a gun that includes an energy store, a gun that includes an electrical circuit, a gun that includes a circuit board, or any combination thereof.

The communication network 700 may facilitate communication between multiple electronic components of the gun, such as communication between a processor and a proximity sensor. The electronic elements of a gun may be communicatively coupled with each other based on being aspects of the communication network 700.

The communication network 700 includes an energy store 705 that is capable of powering electronic elements of the communication network 700. The energy store 705 may be a battery cell, a battery pack, a capacitor, a capacitor bank, or the like. As an illustrative example, the energy store 705 may be a battery pack including one or more batteries, such as a lithium-ion battery, a lithium-ion polymer battery, a lithium cobalt battery, a lithium manganese battery, a lithium phosphate battery, a lithium titanate battery, a lithium-thionyl chloride battery, a nickel cadmium battery, a nickel-metal hydride battery, a zinc-carbon battery, a lead-acid battery, an alkaline battery, or the like.

The energy store 705 may be electronically coupled with an electrical interface 710 such that a conductive path exists between the electrical interface 710 and the energy store 705. The electrical interface 710 may be used to charge the energy store 705, or the energy store 705 may deliver energy to the electrical interface 710. In other words, the electrical interface 710 may be a source of energy for the energy store 705, a sink of energy from the energy store 705, or both. The electrical interface 710 may implement a power protocol, such as USB Power Delivery 2.0, USB Power Delivery 3.1, etc.

The electrical interface 715 may electronically couple the circuit board 720-*a* and the circuit board 720-*b*. The circuit board 720-*a* may be an example of power board that includes a power management integrated circuit (PMIC), and the circuit board 720-*b* may be an example of a processor board that includes a digital processor. The circuit board 720-*a*, the circuit board 720-*b*, the circuit board 720-*c*, the circuit board 720-*d*, and the circuit board 720-*e* are examples of electronic components that may be aspects of a gun described herein.

The circuit board 720-*c* may be electronically coupled with the energy store 705. The circuit board may also be electronically coupled with the circuit board 720-*a* via the communication channel 725-*a* and the electrical interface 710 via the communication channel 725-*b*. The circuit board 720-*c* may be an aspect of a rigid-flex circuit of the communication network 700, as the circuit board 720-*a* may be a rigid circuit board and the communication channel 725-*a* may be a flexible communication channel. A communication channel may implement a communication protocol, such as an I2C protocol, a SPI protocol, a UART protocol, or the like.

The communication network 700 may include a communication channel 725-*a*, a communication channel 725-*b*, a communication channel 725-*c*, a communication channel 725-*d*, a communication channel 725-*e*, a communication channel 725-*f*, and a communication channel 725-*g*. The communication channel 725-*d* may be an example of a flexible communication channel, and the communication channel 725-*d* may be designed to be routed through a trigger guard of a gun. The communication channel 725-*d* may provide a conductive path so as to allow the energy store 705 to power electronic components that are located rearward of the trigger guard (e.g., proximate to a magazine well, proximate to a fingerprint scanner 730-*c*, or proximate to an image sensor 730-*d*).

The communication network 700 may include an LED 730-*a*, a button 730-*b*, the fingerprint scanner 730-*c*, the image sensor 730-*d*, a capacitive proximity sensor 730-*e*, a laser proximity sensor 730-*f*, a ultrasonic proximity sensor 730-*g*, a haptic motor 730-*i*, and a microcontroller 730-*h*. The LED 730-*a*, the button 730-*b*, the fingerprint scanner 730-*c*, the image sensor 730-*d*, the capacitive proximity sensor 730-*e*, the laser proximity sensor 730-*f*, the ultrasonic proximity sensor 730-*g*, the haptic motor 730-*i*, and the microcontroller 730-*h* are examples of electronic components that may be aspects of a gun described herein. The energy store 705 may power the LED 730-*a* via the communication channel 725-*c*.

The communication channel 725-*d* may communicatively couple one or more electronic components located proximate to the energy store 705 with one or more electronic components located proximate to a fingerprint scanner 730-*c*. In other words, the communication channel 725-*d* may communicatively couple one or more electronic components in a forward region of the gun with one or more electronic components in a rearward region of the gun. The forward region of the gun may be forward of a trigger or a trigger guard, and the rearward region of the gun may be rearward of the trigger or the trigger guard. As an example, the communication channel 725-*d* may communicatively couple the circuit board 720-*b* and/or the energy store 705 with the button 730-*b*, the fingerprint scanner 730-*c*, the image sensor 730-*d*, the capacitive proximity sensor 730-*e*, the laser proximity sensor 730-*f*, the ultrasonic proximity sensor 730-*g*, the microcontroller 730-*h*, or the haptic motor 730-*i*.

The communication network 700 may include one or more rigid-flex circuits that support the reliable communication between electronic components of the gun while allowing the gun to be designed in an ergonomic and aesthetically pleasing manner. For example, the circuit board 720-*b* may be an example of a rigid processor board, the circuit board 720-*d* may be an example of a rigid processor board, and the communication channel 725-*d* may be an example of a flexible transmission medium forming a conductive path between the circuit board 720-*b* and the circuit board 720-*d*. As another example, the circuit board 720-*d* may be an example of a rigid circuit board located forward of, and parallel to, a magazine well of the gun, the circuit board 720-*e* may be an example of a rigid circuit board located rearward of, and parallel to, the magazine well of the gun, and the communication channel 725-*f* may be an example of flexible transmission medium forming a conductive path between the circuit board 720-*d* and the circuit board 720-*e*.

Figure 8:
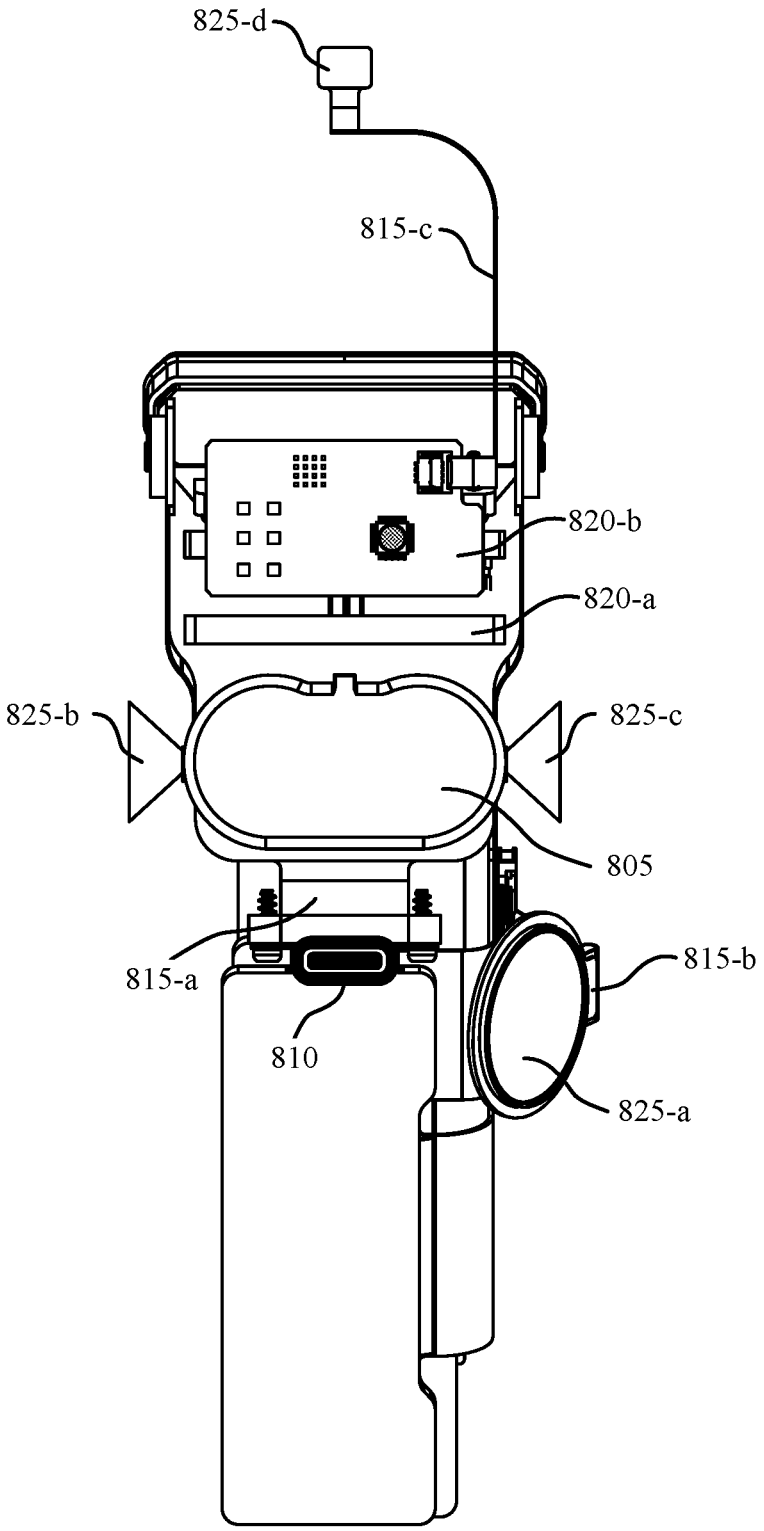
FIG. 8 illustrates an example of a front-side view of a communication network for a gun.

FIG. 8 illustrates an example of a front-side view of a communication network 800. The communication network 800 may be an aspect of a gun described herein.

The communication network 800 includes an energy store 805, an electrical interface 810, a communication channel 815-*a*, a communication channel 815-*b*, a communication channel 815-*c*, a circuit board 820-*a*, a circuit board 820-*b*, a fingerprint scanner 825-*a*, a proximity sensor 825-*b*, a proximity sensor 825-*c*, and an LED 825-*d*. The communication channel 815-*a*, the communication channel 815-*b*, and the communication channel 815-*c* may be used to couple (e.g., communicatively couple or electronically couple) one or more electronic components of the communication network 800, such as the energy store 805, the electrical interface 810, the circuit board 820-*a*, the circuit board 820-*b*, the fingerprint scanner 825-*a*, the proximity sensor 825-*b*, the proximity sensor 825-*c*, or the LED 825-*d*.

Figure 9:
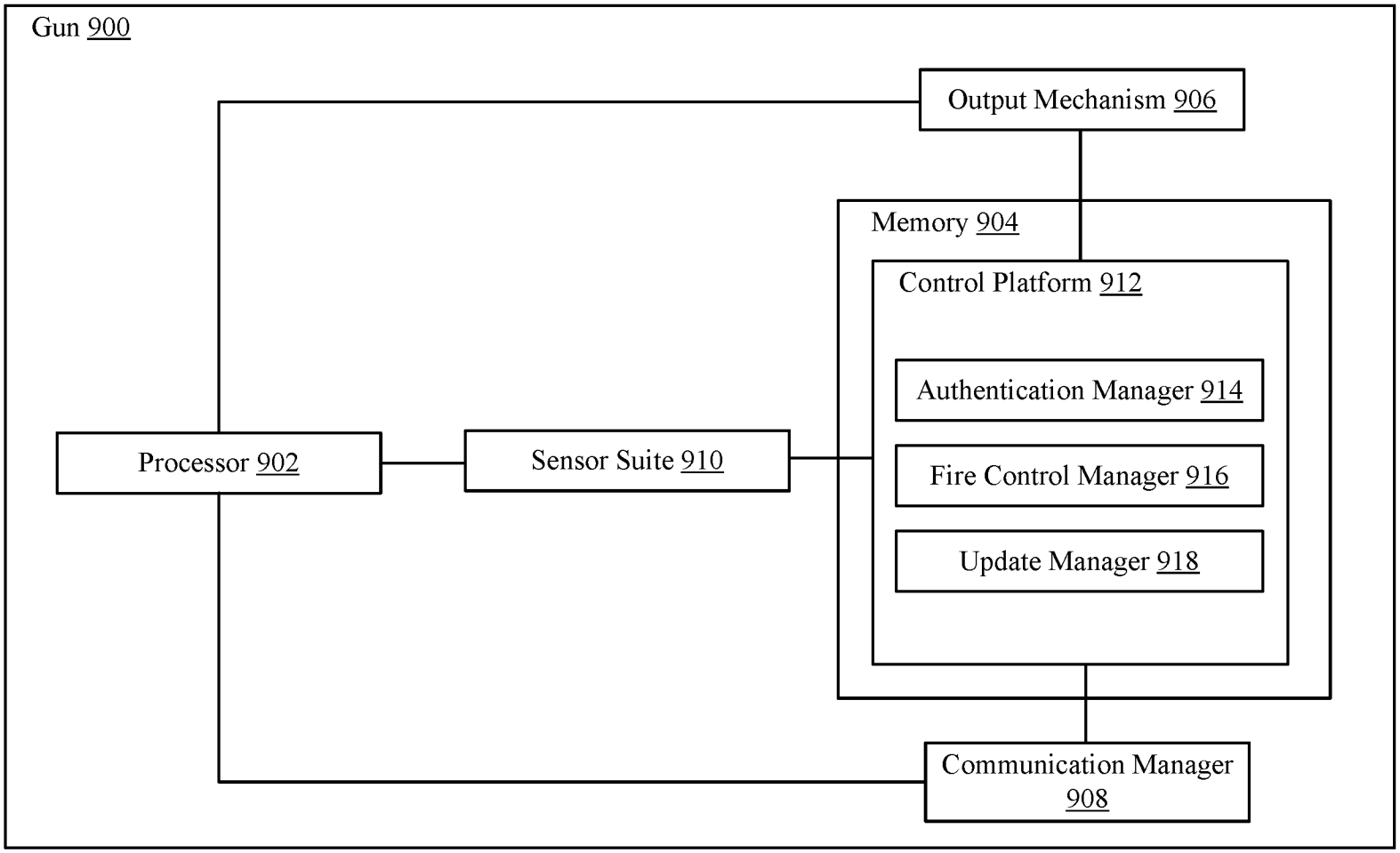
FIG. 9 illustrates an example of a gun that includes both mechanical and electronic components.

FIG. 9 illustrates an example of a gun 900 able to implement a control platform 912 designed to produce outputs that are helpful in ensuring the gun 900 is used in an appropriate manner. As further discussed below, the control platform 912 (also referred to as a "management platform" or a "system manager") may be designed to analyze signals, perform a user authentication procedure, and manage the fire control system of the gun.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips, registers, managers, or electrical circuits.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, a charging state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, Wi-Fi®, Near Field Communication (NFC), and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint scanner or camera that generates images which can be used for, for example, biometric authentication. As yet another example, the gun 900 may include a trigger sensor (e.g., a Hall effect sensor, an optical interrupt sensor, a load cell, etc.) configured to generate an output indicating that a trigger break condition is satisfied. The trigger break condition may be satisfied based on the trigger traveling a threshold distance (e.g., 3 millimeters (mms), 10 mms, or anywhere in between). As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include an authentication manager 914, a fire control manager 916, and an update manager 918. As an illustrative example, the authentication manager 914 may process data obtained from a fingerprint scanner, the fire control manager 916 may transmit an electrical signal to an fire control mechanism, and the update manager 918 may process software data obtained from a device that is external to the gun 900. Because the data obtained by these managers may have different formats, structures, and content, the instructions executed by these managers can (and often will) be different. For example, the instructions executed by the authentication manager 914 to process data obtained from a fingerprint scanner may be different than the instructions generated by the fire control manager 916 to transmit a signal to the fire control mechanism. As a specific example, the authentication manager 914 may implement image processing algorithms (e.g., for binarization, feature extraction, denoising, despeckling, etc.) that are not necessary for transmitting a signal to a fire control mechanism. The fire control manager 916 may be implemented in an analog electrical circuit, which may reduce latency in increase reliability.

As an illustrative example, the communication manager 908 may receive a software update from a device that is external to the gun 900 and the update manager 918 may apply the software update to aspects of the gun 900, such as the processor 902, a proximity sensor, or a biometric sensor. The communication manger 908 may receive the software update via a physical electrical interface of the gun 900 or via a wireless electrical interface of the gun 900. The update manager 918 may verify the authenticity of the software update by verifying a digital signature of the software update, verifying a digital certificate of the software update, performing a random challenge, or any combination thereof. In some examples, the update manager 918 may verify the integrity of the software update by generating a checksum value for the received software and comparing the generated checksum to a predetermined checksum value. The update manager 918 may determine that the software update is uncorrupted based on the generated checksum value matching the predetermined checksum value, and the update manager 918 may determine that the software update is corrupted based on the generated checksum not matching the predetermined checksum. The update manager 918 may apply the software update based on determining that the software update is authentic and/or uncorrupted. In some examples, the processor 902 may reboot based on applying the software update. Applying the software update may result in defining or modifying a user authentication procedure, a user enrollment procedure, a facial recognition procedure, a fingerprint recognition procedure, a communication protocol, or the like.

Figure 10:
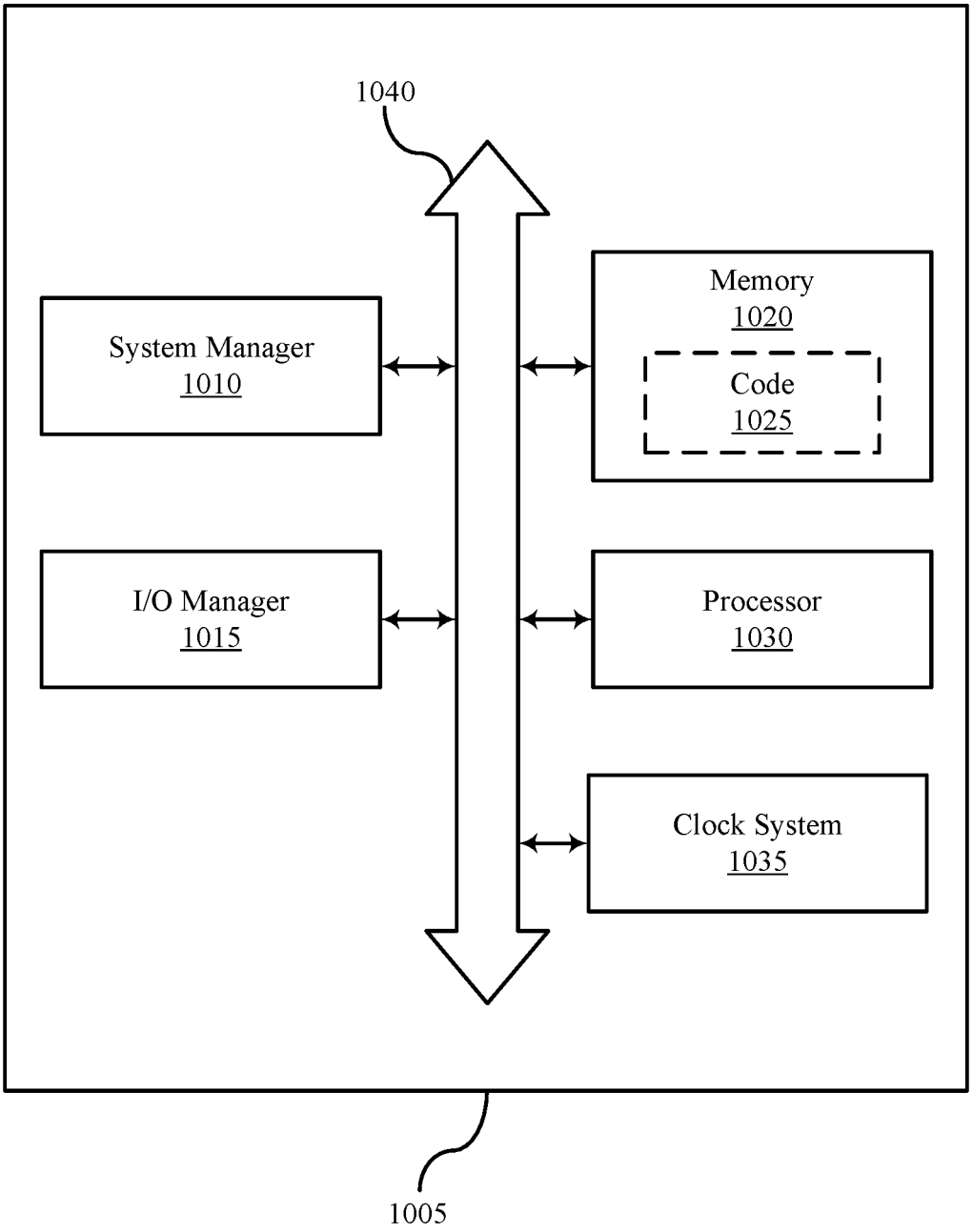
FIG. 10 illustrates an example of a system that may be implemented by an electromechanical gun.

FIG. 10 illustrates an example of a system 1000 that may be implemented by a gun. The device 1005 may be operable to implement the techniques, technology, or systems disclosed herein. The device 1005 may include components such as a system manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a gun.

The system manager 1010 may identify a trigger beak, determine that a logical condition is satisfied, and cause the device 1005 to fire a projectile based on the trigger break and the logical condition being satisfied. For example, the system manager 1010 may monitor a signal voltage generated by a Hall effect sensor, determine that the signal voltage satisfies a voltage threshold, and transmit an activation signal to a capacitor bank based on an output of a latch or flip-flop so as to cause the capacitor bank to discharge electric current. The signal satisfying the signal voltage may indicate that the trigger has been pulled sufficiently such that a trigger break condition is satisfied, and output of the latch or flip-flop may indicate that the gun is in an unlocked state (which may be referred to as an "armed state"). The latch or flip-flop may generate the output based on a user authentication procedure indicating that a user is authorized to operate the device 1005, based on a proximity sensor indicating that a user is holding the device 1005, or based on both.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux®, Unix®, or the like. The clock system 1035 control a timer for use by the disclosed embodiments.

The system manager 1010, or its sub-components, may be implemented in hardware, software (e.g., software or firmware) executed by a processor, or a combination thereof. The system manager 1010, or its sub-components, may be physically located in various positions. For example, in some cases, the system manager 1010, or its sub-components may be distributed such that portions of functions are implemented at different physical locations by one or more physical components.

FIG. 11 illustrates an example of a flowchart 1100 showing a method of manufacturing an electromechanical gun. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1105). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

The manufacturer or another entity may generate, store, deploy, or otherwise manage cryptographic data associated with a device. For example, the manufacturer may deploy a cryptographic secret (e.g., a cryptographic key used for deriving a cryptographic key) into memory of the device to support encryption and decryption at the device, the manufacturer may deploy a public cryptographic key into the memory of the device to support verifying cryptographic signatures, the manufacturer may deploy a private cryptographic key into the memory of the device to support generating cryptographic signatures, or the manufacturer may deploy a digital certificate into the memory of the device to cryptographically identify the manufacture or an associated entity.

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

The manufacturer may develop and/or test a communication network. In some examples, the communication network may be an aspect of the gun. For example, the communication network may include a proximity sensor and an energy store capable of powering the proximity sensor. The manufacturer may also develop instructions that support performing functions at a processor, a controller, a system manager, or a fire control manager. For example, the manufacturer may produce software and/or firmware that supports measuring ambient light and modifying the brightness of an electronic aiming sight of the gun based on the amount of ambient light measured. As another example, the manufacturer may produce an electrical circuit that determines whether to fire the gun and transmits an electrical signal to a fire control mechanism to cause the gun to fire in response to the fire control manager identifying a trigger break.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

FIG. 12 shows a flowchart illustrating a method 1200 of firing an electromechanical gun. The operations of the method 1200 may be implemented by a gun or its components as described herein. For example, the operations of the method 1200 may be performed by a system manager or a fire control manager as described herein. In some examples, a gun may execute a set of instructions to control the functional elements of the to perform the described functions. Additionally or alternatively, the gun may perform aspects of the described functions using special-purpose hardware.

At step 1205, the fire control manager may identify a trigger break. For example, the fire control manager may identify the trigger break based on a Hall effect sensor generating an output that satisfies a threshold. The output of the Hall effect sensor may represent the strength and/or direction of an electromagnetic field, and the fire control manager may identify the trigger beak based on the output satisfying the threshold. As another example, the fire control manager may identify the trigger break based on an optical interrupt sensor generating an output that satisfies a threshold. The output of the optical interrupt sensor may represent an amount of light being received at a receiving lens of the optical interrupt sensor, and the fire control manager may identify the trigger break based on the output satisfying the threshold. In some examples, the fire control manager may identify the trigger break based on the Hall effect sensor generating a first output indicating that a first threshold is satisfied and the optical interrupt sensor generating a second output indicating that a second threshold is satisfied.

At step 1210, the fire control manager may activate a fire control mechanism. The fire control manager may activate the fire control mechanism by transmitting an electrical signal to the fire control mechanism. Transmitting the electrical signal to the fire control mechanism may result in the fire control mechanism causing a cartridge propellant to ignite and a projectile to be propelled through a barrel. For example, the fire control mechanism may release a sear, release a firing pin, driving a firing pin into a primer cap of a cartridge, heat an electronic firing pin, or transmit a beam of light at a propellant so as to cause a projectile to be accelerated through the barrel of the gun.

At step 1215, the fire control mechanism may be reset. In some examples, the fire control mechanism may be reset based on a slide recoiling reward and contacting a reset lever. For example, the fire control mechanism may be displaced downward as a result of the electrical signal, and the slide may contact a rest tab of the fire control mechanism as the slide is moving reward, and contacting the reset tab may result in the fire control mechanism being displaced upward such that the fire control mechanism retains a firing pin, a striker, a hammer, a sear, or the like. In some examples, the fire control mechanism may include a bank of capacitors and the bank of capacitors may be charged with electric charge so as to reset the fire control mechanism. The electrical signal may include electric charge temporarily stored in the bank of capacitors, and the electrical signal may be transmitted to a conductive firing pin that is configured to ignite a propellant of an electronically activated cartridge.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Examples

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a gun including: a barrel with helical grooves along an internal surface for the purpose of exerting torque on a projectile traveling therethrough, wherein the barrel is located within a slide of the gun; a cylindrical spring enveloping the barrel, wherein the barrel is configured to act as a guide rod for the cylindrical spring, and wherein the cylindrical spring is configured to bias the slide in a first position; a locking mechanism configured to temporarily lock the barrel to the slide such that the barrel and the slide collectively move rearward for a first distance and the slide independently moves rearward for a second distance while the barrel remains stationary; a processor located beneath the barrel and forward of a trigger guard when the gun is in an upright position; a battery that is electronically coupled with the processor, wherein the battery is located beneath the barrel and forward of the trigger guard when the gun is in the upright position; an electronic component located rearward of the trigger guard when the gun is in the upright position; and a physical communication channel that electronically couples the battery and the electronic component, wherein the physical communication channel is encapsulated within the trigger guard.

In some examples, the techniques described herein relate to a gun including: a barrel located within a slide of the gun; a cylindrical spring enveloping the barrel, wherein the barrel is configured to act as a guide rod for the cylindrical spring, and wherein the cylindrical spring is configured to bias the slide in a battery position; a processor located below the barrel when the gun is in an upright position; and an energy store that is electronically coupled with the processor, wherein the energy store is located below the barrel and forward of a trigger guard when the gun is in the upright position.

In some examples, the techniques described herein relate to a gun, further including: an actuator that is configured to cause the gun to fire a projectile in response to being activated, wherein the actuator is electronically coupled with the energy store, and wherein the actuator is activated by either (i) directing electric current at a solenoid of the actuator or (ii) directing electric current at a piezoelectric element of the actuator.

In some examples, the techniques described herein relate to a gun, further including: a capacitor that is electronically coupled with the energy store and the actuator, wherein the energy store is configured to charge the capacitor, and wherein the capacitor is configured to discharge electric charge into the actuator.

In some examples, the techniques described herein relate to a gun, further including: an electronic component located rearward of the trigger guard; and a physical communication channel electronically coupling the processor the electronic component, the physical communication channel being encapsulated within the trigger guard.

In some examples, the techniques described herein relate to a gun, further including: a rigid-flex assembly that includes: an electronic component located on a rigid circuit board; the processor located below the barrel; and a flexible circuit coupling the rigid circuit board and the processor.

In some examples, the techniques described herein relate to a gun, further including: an electronic component including a biometric sensor, a proximity sensor, or a haptic motor; and a physical communication channel electronically coupling the energy store and the electronic component.

In some examples, the techniques described herein relate to a gun, further including: a physical electronic interface configured to mate with a complementary physical electronically interface of an electronic device external to the gun.

In some examples, the techniques described herein relate to a gun, wherein the physical electronic interface is electronically coupled with the energy store or the processor.

In some examples, the techniques described herein relate to a gun, wherein the physical electronic interface includes a universal serial bus type-C interface.

In some examples, the techniques described herein relate to a gun, further including: a locking mechanism configured to temporarily lock the barrel to the slide such that the barrel and the slide collectively move rearward in response to propelling a projectile through the barrel.

In some examples, the techniques described herein relate to a gun, further including: a falling block mechanically coupling the barrel and a chassis of the gun, wherein the falling block is configured to move rearward along the chassis for a first distance until captured by a groove of the chassis, and wherein the slide is configured to move rearward along the chassis to for a second distance that is larger than the first distance.

In some examples, the techniques described herein relate to a gun, further including: a delayed blowback mechanism configured to temporarily inhibit rearward movement of the slide when a projectile is propelled through the barrel of the gun.

In some examples, the techniques described herein relate to a gun, further including: a piston mechanically coupled with the slide, wherein the piston is located within a chamber located below the barrel, the barrel including a port configured to direct gas from the barrel into the chamber so as to increase pressure in the chamber and prevent the piston from moving rearward, and therefore also prevent the slide from moving rearward, until a projectile exits the barrel and causes the pressure in the chamber to decrease.

In some examples, the techniques described herein relate to a gun, further including: a capacitor that is electronically coupled with the energy store, wherein the capacitor is located below the barrel and forward of the trigger guard when the gun is in the upright position.

In some examples, the techniques described herein relate to a gun, further including: a feed ramp configured to direct cartridges into a breech from a magazine well.

In some examples, the techniques described herein relate to a gun, wherein the energy store includes a battery.

In some examples, the techniques described herein relate to a gun, wherein the processor is electronically coupled with the energy store via a physical transmission medium.

In some examples, the techniques described herein relate to a gun including: a barrel located within a slide of the gun; a processor that is located beneath the barrel while the gun is in an upright position; an energy store that is electronically coupled with the processor, wherein the energy store is located below the barrel when the gun is in the upright position; an electronic component located below the barrel when the gun is in the upright position; a physical communication channel electronically coupling the energy store and the electronic component, wherein the physical communication channel is at least partially encapsulated within a trigger guard; and a physical electronic interface configured to mate with a complementary physical electronic interface, wherein the physical electronic interface provides a conductive path to the energy store.

In some examples, the techniques described herein relate to a gun, further including: a rigid-flex assembly of electronic components, the rigid-flex assembly including: an electronic component located on a rigid circuit board; the processor located below the barrel; and a flexible circuit coupling the rigid circuit board and the processor.

In some examples, the techniques described herein relate to a gun, further including: a fingerprint scanner that is electronically coupled with the energy store, wherein the fingerprint scanner is located below the barrel when the gun is in the upright position.

In some examples, the techniques described herein relate to a gun, wherein the electronic component includes an image sensor, and wherein the processor is configured to perform a facial recognition procedure on an image capture by the image sensor.

In some examples, the techniques described herein relate to a gun, wherein the electronic component includes a fingerprint scanner, and wherein the processor is configured to perform a fingerprint recognition procedure on an fingerprint capture by the fingerprint scanner.

In some examples, the techniques described herein relate to a gun, wherein the electronic component includes a laser proximity sensor that is configured to generate a signal representing an amount of light.

In some examples, the techniques described herein relate to a gun, wherein the electronic component is further configured to generate an output in response to determining that the signal representing the amount of light satisfies a threshold.

In some examples, the techniques described herein relate to a gun, wherein the electronic component includes a capacitive proximity sensor that is configured to generate a signal representing a capacitance.

In some examples, the techniques described herein relate to a gun, wherein the electronic component is further configured to generate an output in response to determining that the signal representing the capacitance satisfies a threshold.

In some examples, the techniques described herein relate to a gun, wherein the electronic component includes a haptic motor that is configured to generate a haptic pulse.

In some examples, the techniques described herein relate to a gun, wherein the processor is further configured to perform a user authentication procedure based on a signal generated by the electronic component.

In some examples, the techniques described herein relate to a gun, wherein the processor is configured to determine that a user is holding the gun based on a signal generated by the electronic component.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a system manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A gun that has a frame onto which other components are integrated, the gun comprising:

a slide that is movable upon the frame;

a recoil spring coupled with the slide that is configured to bias the slide in battery;

a locking mechanism that moveably couples a barrel with the slide such that both the barrel and the slide can travel together for a distance;

an energy store located below the barrel when the gun is in an upright position; and a camera configured to generate an image to be analyzed as part of a facial recognition procedure.

2. The gun of claim 1, further comprising:

a communication channel embedded in a trigger guard of the gun, wherein the communication channel couples the camera with the energy store.

3. The gun of claim 1, further comprising:

an electronically activated actuator coupled with the energy store, wherein the electronically activated actuator is activated based on the energy store discharging electric charge.

4. The gun of claim 3, wherein the camera is coupled with the energy store, and wherein the electronically activated actuator is activated further based on the facial recognition procedure determining that a user of the gun is authorized to operate the gun.

5. The gun of claim 3, wherein the electronically activated actuator is configured to disengage a safety mechanism in response to being activated.

6. The gun of claim 3, wherein the electronically activated actuator is configured to release a sear in response to being activated.

7. The gun of claim 1, wherein the energy store is located forward of a trigger when the gun is in the upright position.

8. The gun of claim 1, wherein the camera is located rearward of a trigger when the gun is in the upright position.

9. The gun of claim 1, wherein the camera is located below the slide when the gun is in the upright position.

* * * * *